US007402964B1

(12) United States Patent
Calhoun

(10) Patent No.: US 7,402,964 B1
(45) Date of Patent: Jul. 22, 2008

(54) RACE CAR SYSTEM

(76) Inventor: Bradley Calhoun, 558 Rocky Spring La., Linden, VA (US) 22642

( * ) Notice: Subject to any disclaimer, the term of this patent is extended or adjusted under 35 U.S.C. 154(b) by 82 days.

(21) Appl. No.: 11/433,717

(22) Filed: May 12, 2006

(51) Int. Cl.
*B60K 6/04* (2006.01)

(52) U.S. Cl. ..... 318/9; 318/11; 318/6; 463/6; 446/454; 446/460

(58) Field of Classification Search ..... 318/16, 318/9, 11, 14, 6; 463/6; 446/454, 456, 460, 446/468
See application file for complete search history.

(56) References Cited

U.S. PATENT DOCUMENTS 4,817,948 A * 4/1989 Simonelli ..... 463/6
5,596,319 A * 1/1997 Spry ..... 340/903
5,865,624 A * 2/1999 Hayashigawa ..... 434/66
5,919,045 A * 7/1999 Tagge et al. ..... 434/62
6,568,983 B1 * 5/2003 Peters ..... 446/175

* cited by examiner

*Primary Examiner*—Rina I Duda

(57) ABSTRACT

A race car system is disclosed. An illustrative embodiment of the race car system includes at least one car, at least one video camera provided on the at least one car, a car transmitter/receiver connected to the at least one video camera, a remote control transmitter/receiver adapted to exchange transmission signals with the car transmitter/receiver, a remote control central processing unit having a screen connected to the remote control transmitter/receiver and a speed control unit and a steering control unit connected to the remote control central processing unit.

5 Claims, 3 Drawing Sheets

RACE CAR SYSTEM

FIELD

The present invention relates to remote control model vehicles. More particularly, the present invention relates to a virtual reality-type race car system which includes at least one remote-controlled car that can be driven around a racetrack and is equipped with at least one video camera that simultaneously transmits images for display on a computer screen or the like.

BACKGROUND

A variety of remote-controlled model vehicles are known which can be driven on a simulated racetrack or other surface. A typical remote-controlled model vehicle includes a wheeled vehicle having a motor and steering mechanism which engages the wheels. A transmitter which is typically held by a person controlling the vehicle broadcasts control signals to a vehicle-mounted receiver which controls the motor and steering mechanism of the vehicle to facilitate forward, rearward and steering motions of the vehicle. During operation of the vehicle, the person controlling the vehicle has a limited perspective due to sitting or standing in a fixed position outside the vehicle. Therefore, the ability to view a racetrack or other surface from the vantage point of the remote-controlled vehicle would enhance the experience of operating the vehicle.

SUMMARY

The present invention is generally directed to a race car system. An illustrative embodiment of the race car system includes at least one car, at least one video camera provided on the at least one car, a car transmitter/receiver connected to the at least one video camera, a remote control transmitter/receiver adapted to exchange transmission signals with the car transmitter/receiver, a remote control central processing unit having a screen connected to the remote control transmitter/receiver and a speed control unit and a steering control unit connected to the remote control central processing unit.

BRIEF DESCRIPTION OF THE DRAWINGS

The invention will now be described, by way of example, with reference to the accompanying drawings, in which.

DETAILED DESCRIPTION

Figure 2:
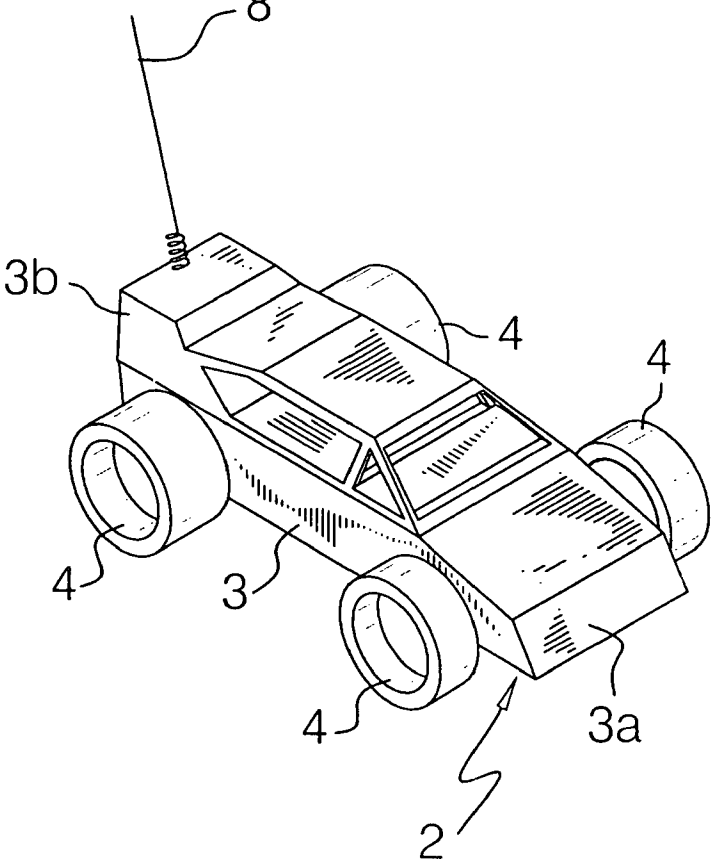
FIG. 2 is a perspective view of a remote-controlled car which is suitable for implementation of an illustrative embodiment of a race car system.
Figure 4:
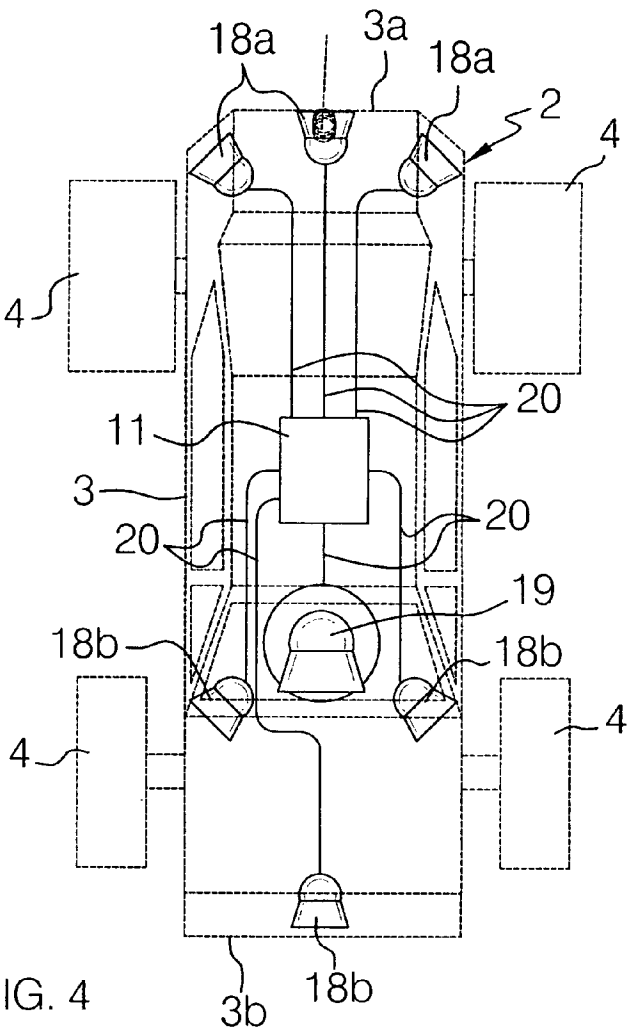
FIG. 4 is a top view of a remote-controlled car suitable for implementation of an illustrative embodiment of a race car system, with a car central processing unit and multiple video cameras fitted to the car.

Referring to the drawings, an illustrative embodiment of a race car system includes at least one remote-controlled car 2 and a car control system 10 adapted to control the at least one car 2. As shown in FIGS. 2 and 4, the car 2 typically includes a car body 3 which may have the general shape of a race car of selected design, for example. Alternatively, the car body 3 may have the general shape of a sport-utility vehicle (SUV) (not shown) or other type of vehicle. The car body 3 has a front end 3*a* and a rear end 3*b*. Front and rear wheels 4 are provided on the car body 3. An antenna 8 is provided on the car body 3. A motor (not shown) and steering mechanism (not shown) are provided in the car body 3 and each drivingly engages the wheels 4.

Figure 6:
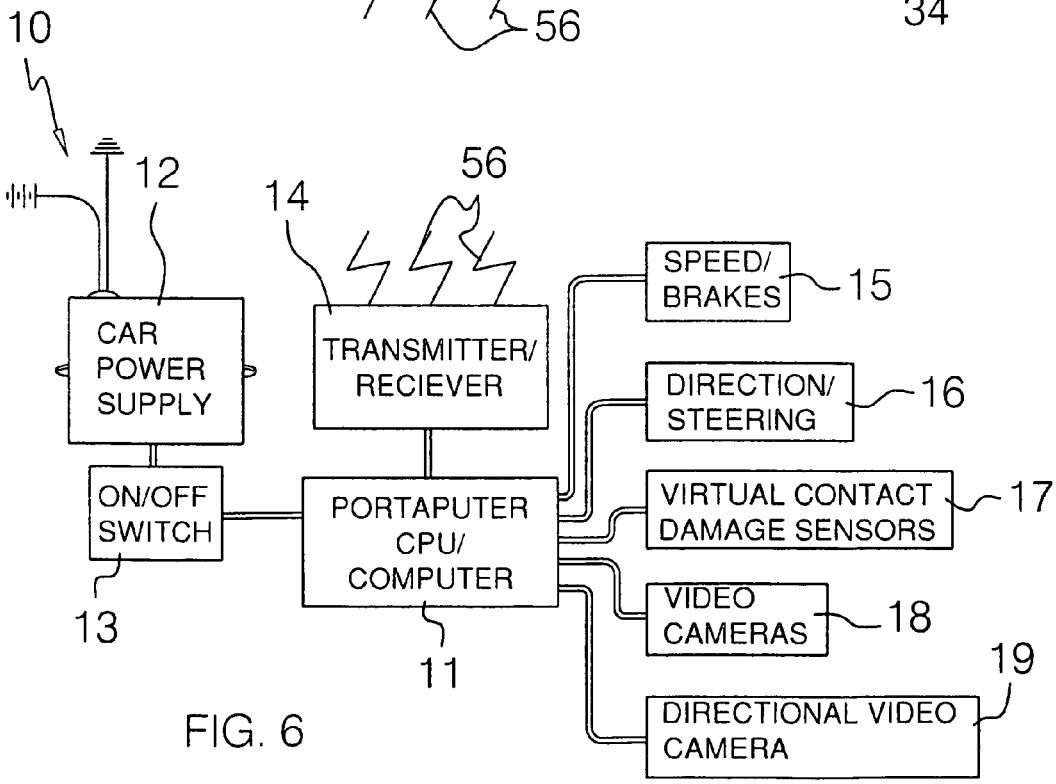
FIG. 6 is a block diagram illustrating a car control system which is suitable for implementation of an illustrative embodiment of a race car system.

As shown in FIG. 6, a car control system 10 for the car includes a car central processing unit (CPU) 11 which controls the various operational aspects of the car 2, as will be hereinafter described. A car power supply 12, which may be at least one battery, for example, is connected to the car CPU 11. A car power switch 13 is provided between the car CPU 11 and the car power supply 12 to facilitate turning the car 2 on and off and may be provided on any suitable location on the car body 3. A car transmitter/receiver 14 is provided on or inside the car body 3 and is connected to the antenna 8 (FIG. 2).

As further shown in FIG. 6, various car controls are connected to the car CPU 11. These may include, for example, a speed/brake control 15 which is connected to the motor (not shown) of the car 2; a steering control 16 which is connected to the steering mechanism (not shown) of the car 2; virtual contact damage sensors 17; video cameras 18; and a directional video camera 19. As shown in FIG. 4, the video cameras 18 may include, for example, one or multiple front video cameras 18*a* and/or one or multiple rear video cameras 18*b*. The directional video camera 19 may be provided on the rear portion, as shown, or alternatively, on the front portion of the car body 3. The video cameras 18 and directional video camera 19 are each connected to the car CPU 11 typically via wiring 20.

Figure 1:
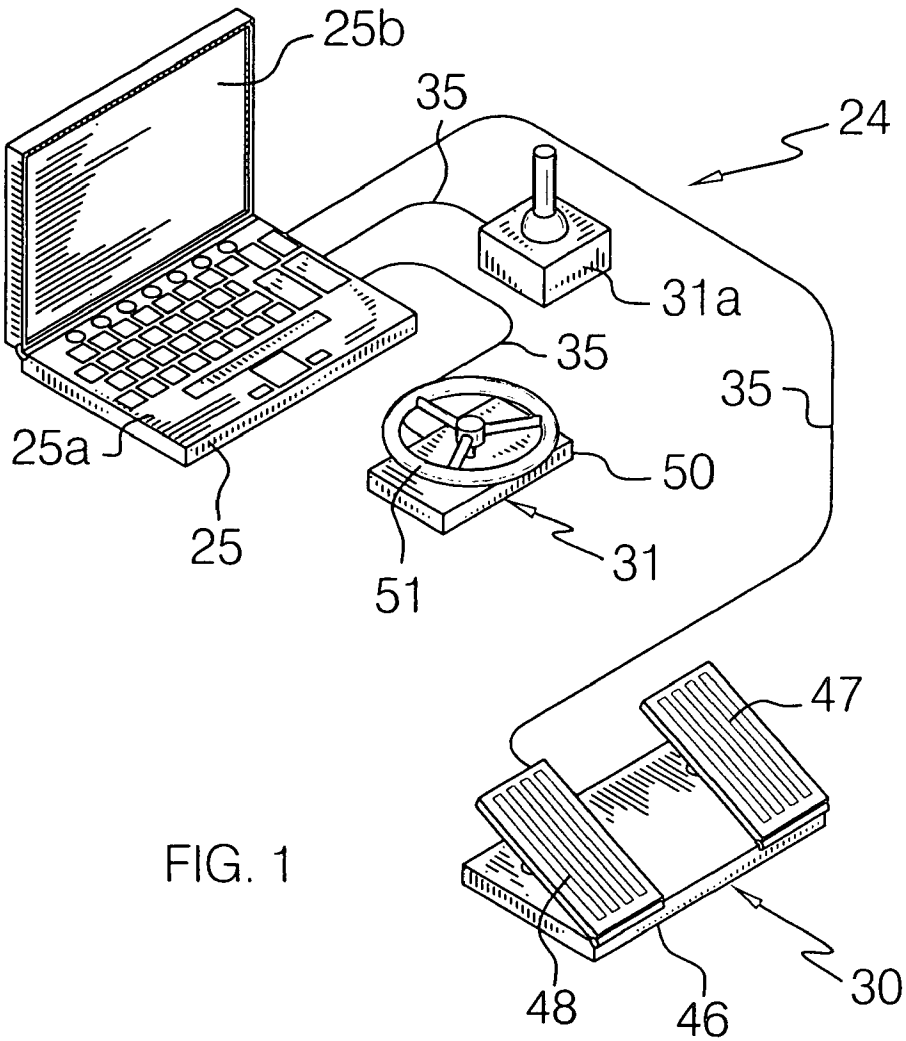
FIG. 1 is a perspective view of a remote control system which is suitable for implementation of an illustrative embodiment of a race car system.
Figure 5:
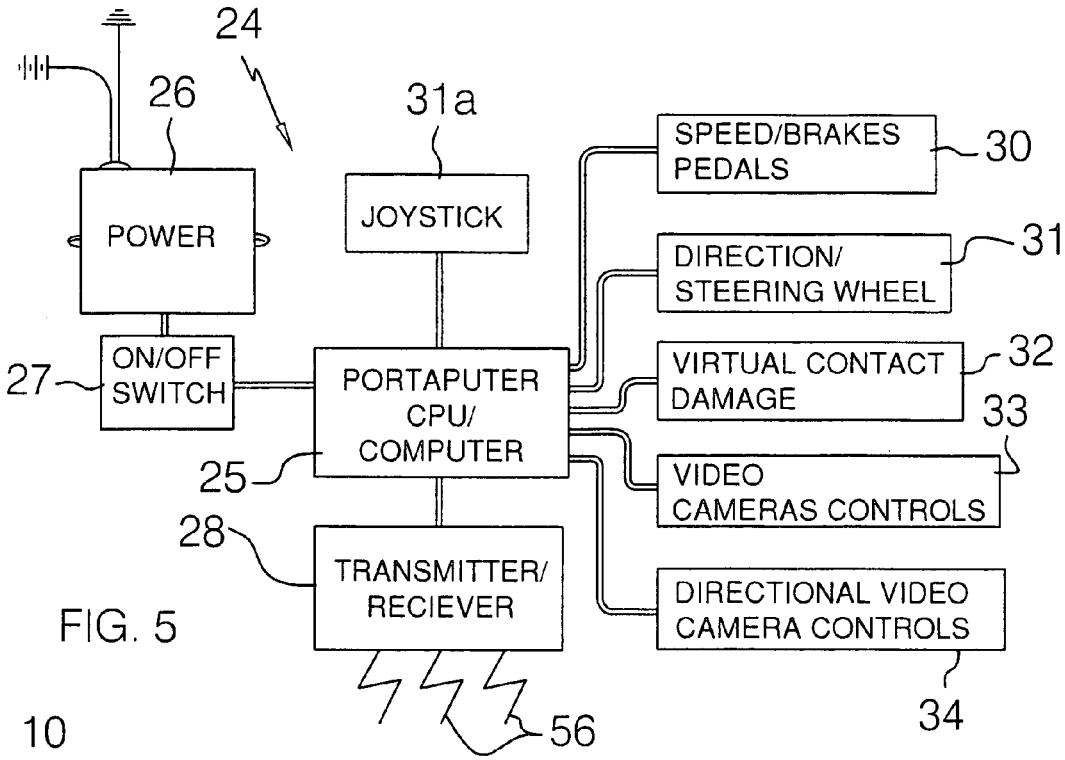
FIG. 5 is a block diagram illustrating a remote control system which is suitable for implementation of an illustrative embodiment of a race car system.

A remote control system 24 which is suitable for controlling operation of the car 2 is shown in FIGS. 1 and 5. The remote control system 24 typically includes a remote control central processing unit (CPU) 25, which may be a processor of a desktop or laptop computer, for example, having a keyboard 25*a* and a screen 25*b*, as shown in FIG. 1. A power supply 26, which may be at least one battery or an AC electrical power supply, for example, is connected to the remote control CPU 25. A remote control power switch 27 is provided between the remote control CPU 25 and the remote control power supply 26 to facilitate selectively turning the remote control system 24 on and off. A remote control transmitter/receiver 28 is connected to the remote control CPU 25. A speed/brake control unit 30 is connected to the remote control CPU 25. As shown in FIG. 1, the speed/brake control unit 30 may include, for example, a base 46 and an accelerator pedal 47 and a brake pedal 48 provided on the base 46. A steering control 31 is connected to the remote control CPU 25. As shown in FIG. 1, the steering control 31 may include, for example, a base 50 and a steering wheel 51 provided on the base 50. Alternatively, the steering control 31 may include a joystick control 31*a* which is connected to the remote control CPU 25. The speed/brake control unit 30, the steering control 31 and the joystick 31*a* are connected to the remote control CPU 25 typically via cables 35 plugged into USB ports (not shown), for example, on the remote control CPU 25. Accordingly, during operation of the car 2 as will be hereinafter described, the accelerator pedal 47 is depressed on the base 46 to accelerate the car 2, whereas the brake pedal 48 is depressed on the base 46 to decelerate or stop the car 2. The steering wheel 51 or joystick control 31*a* is operated to steer the car 2.

As shown in FIG. 5, a virtual contact damage mechanism 32 may be connected to the remote control CPU 25 to simulate contact damage to the car 2 responsive to input from the virtual contact damage sensors 17 on the car body 3, as will be hereinafter described. Video camera controls 33 are connected to the remote control CPU 25 to control the various video cameras 18 in the car body 3 of the car 2. Directional video camera controls 34 are connected to the remote control CPU 25 to control the directional video camera 19 in the car body 3.

Figure 3:
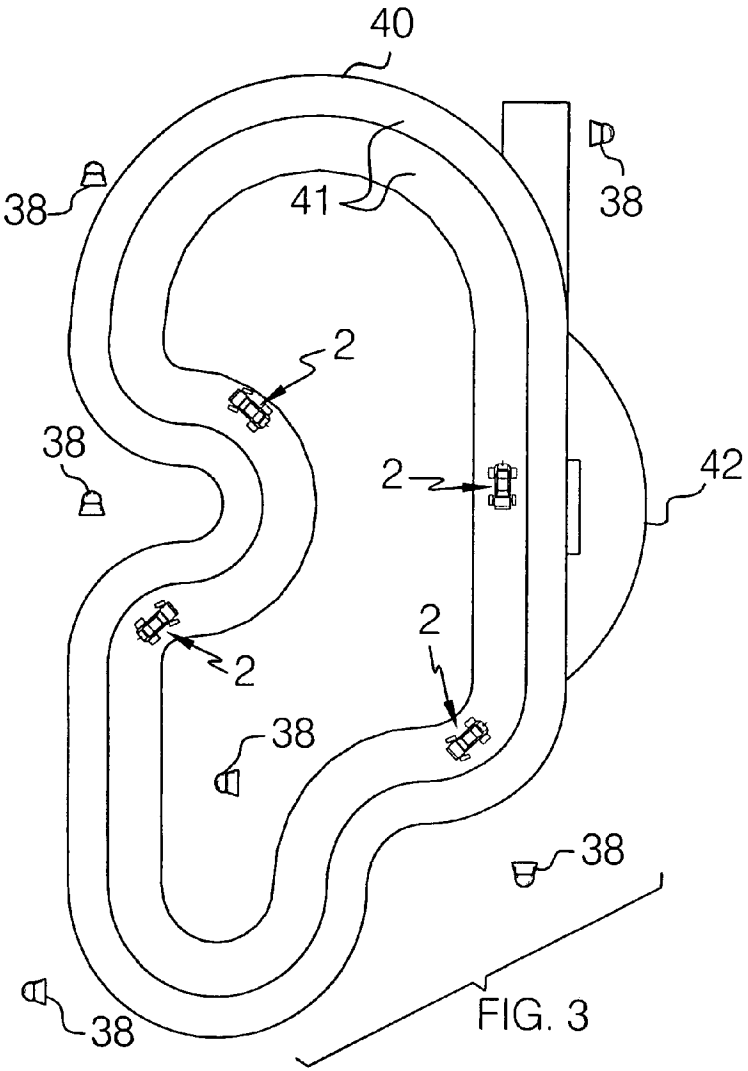
FIG. 3 is a top view of a race track which is suitable for implementation of an illustrative embodiment of a race car system.

As shown in FIG. 3, the remote-controlled cars 2 can be driven on a simulated racetrack 40, as will be hereinafter described. The simulated racetrack 40 may have any desired shape or configuration. The simulated racetrack 40 may include multiple, adjacent lanes 41 to accommodate multiple lanes of the cars 2. The simulated racetrack 40 may additionally include a pit stop area 42. One or multiple track video cameras 38 may be positioned at one or multiple positions around the simulated racetrack 40 for purposes which will be hereinafter described. The track video cameras 38 may be connected to the remote control CPU 25 through a USB port (not shown), for example.

The remote control CPU 25 of the remote control system 24, with supporting software, has the capability to control the speed/brake control 15, steering control 16, video cameras 18 and directional video camera 19 of the car control system 10 on the car 2, responsive to user input through the speed/brake control unit 30, steering control 31, video camera controls 33 and directional video camera controls 34, respectively, of the remote control system 24. The remote control CPU 25 has the capacity to facilitate the transmission of transmission signals 56 from the remote control transmitter/receiver 28 of the remote control system 24 to the car transmitter/receiver 14 of the car control system 10 to effect control of the speed/brake control 15, steering control 16, video cameras 18 and directional video camera 19.

The car CPU 11 of the car control system 10, with supporting software, has the capability to transmit images sighted by the video cameras 18 and directional video camera 19 in the form of transmission signals 56 from the car transceiver 14 of the car control system 10 to the transmitter/receiver 28 of the remote control system 24. The remote control CPU 25 has the capability to display the images from the video cameras 18 and directional video camera 19 on the screen 25*b* (FIG. 1) of the remote control CPU 25. The remote control CPU 25 also has the capability to receive images sighted by the track video cameras 38 and display one or more of these images on the screen 25*b* of the remote control CPU 25. Furthermore, the car CPU 11 has the capability to sense contact or collision of the car 2 with other cars 2 or with stationary surfaces (not shown), such as during travel of the car 2 on the racetrack 40, for example, through the virtual contact damage sensors 17. The car CPU 11 has the capability to transmit indications of this contact in the form of transmission signals 56 from the car transmitter/receiver 14 to the remote control transmitter/receiver 28 of the remote control system 24. In turn, the remote control CPU 25 has the capability to simulate damage to the car 2 by superimposing the simulated damage on the digital image of the car 2 on the screen 25*b* of the remote control CPU 25 as one or more of the track video cameras 38 sights the car 2. The remote control CPU 25 may be configured to selectively present the multiple images from the video cameras 18, directional video camera 19 and track video camera or cameras 38 in a split-screen or multi-screen format on the screen 25*b* or in an individual format, depending on the desires of the user.

In typical use, One or multiple cars 2 are driven on the racetrack 40. The remote control system 24 is turned on typically using the remote control power switch 27, and the car control system 10 of each car 2 is turned on typically using the car power switch 13. An operator (not shown) of each car 2 accelerates and decelerates or stops the car 2 using the speed/brake control unit 30 and steers the car 2 around the racetrack 40 using the steering control 31. The operator can typically control which of the video cameras 18 and directional video camera 19 is operational on the car 2 using the video camera controls 33 and directional video camera controls 34 typically using inputs on the keyboard 25*a* of the remote control CPU 25. As the car 2 traverses the racetrack 40, the video cameras 18 and/or directional video camera 19 sight images which are displayed on the screen 25*b* of the remote control CPU 25. Because the video cameras 18 and directional video camera 19 are provided on the car 2, these images are viewed from the perspective of a race car driver seated in the car 2. Additionally or alternatively, one or more of the track video cameras 38 may be operated to sight the car 2 as it traverses the racetrack 40. The remote control CPU 25 displays these images on the screen 25*b* of the remote control CPU 25, instead of or in addition to the images sighted by the video cameras 18 and/or directional video camera 19. In the event that the car 2 contacts or collides with another car 2 or other surfaces on the racetrack 40, the virtual contact sensors 17 on the car 2 sense this contact and indicate this contact to the car CPU 25, typically in the manner which was heretofore described. The car CPU 25 superimposes damage corresponding to the contact on the image of the car 2 which is sighted by one or more of the track video cameras 38 and displayed on the screen 25*b*. The remote control system 24 and car control system 10 are turned off typically using the remote control power switch 27 and car power switch 13, respectively.

While the preferred embodiments of the invention have been described above, it will be recognized and understood that various modifications can be made in the invention and the appended claims are intended to cover all such modifications which may fall within the spirit and scope of the invention.

What is claimed is:

1. A race car system, comprising:

at least one car;

a car central processing unit carried by said at least one car;

a speed control and a steering control provided on said at least one car and connected to said car central processing unit;

at least one video camera carried by said at least one car and connected to said car central processing unit;

a car transmitter/receiver connected to said car central processing unit;

a remote control transmitter/receiver adapted to exchange transmission signals with said car transmitter/receiver;

a remote control central processing unit having a screen connected to said remote control transmitter/receiver; and a speed control unit and a steering control unit connected to said remote control central processing unit and adapted to control said speed control and said steering control on said at least one car said steering control unit comprises a base and a steering wheel carried by said base or a joystick control.

2. The race car system of claim 1 wherein said at least one video camera comprises at least one front video camera provided at a front end of said at least one car and at least one rear video camera provided at a rear end of said at least one car.

3. The race car system of claim 2 wherein said at least one video camera further comprises at least one directional video camera.

4. The race car system of claim 1 wherein said speed control unit comprises a base and an accelerator pedal and a brake pedal carried by said base.

5. The race car system of claim 1 further comprising at least one virtual contact damage sensor provided on said at least one car and connected to said car transmitter/receiver.

* * * * *